US005507928A

United States Patent [19]

Böhmert et al.

[11] Patent Number: 5,507,928

[45] Date of Patent: Apr. 16, 1996

[54] PROCESS FOR THE PRODUCTION OF MULTI-LAYER LACQUER COATINGS

[75] Inventors: Reiner Böhmert, Haan; Matthias Kimpel, Schwelm; Klausjörg Klein, Wuppertal; Manfred Stein, Hürth, all of Germany

[73] Assignee: Herberts GmbH, Wuppertal, Germany

[21] Appl. No.: 307,523

[22] Filed: Sep. 16, 1994

[30] Foreign Application Priority Data

Sep. 17, 1993 [DE] Germany ..... 43 31 673.5

[51] Int. Cl.[6] ..... C25D 13/00

[52] U.S. Cl. ..... 204/488; 204/500; 204/507

[58] Field of Search ..... 204/181.1, 181.7

[56] References Cited

U.S. PATENT DOCUMENTS

Re. 32,261 7/1986 Hirota et al. ..... 525/285

5,212,265 5/1993 Franks et al. ..... 525/523

*Primary Examiner*—John Niebling
*Assistant Examiner*—Kishor Mayekar
*Attorney, Agent, or Firm*—Schweitzer Cornman & Gross

[57] ABSTRACT

Process for the production of multi-layer lacquer coatings by electrophoretic deposition of a first coating layer of a first, aqueous coating composition onto an electrically conductive substrate, application of a second coating layer based on a second, powder coating composition and joint baking of the coating layers so obtained, which process is characterised in that a powder coating composition is used for the second coating layer which is based on binders which contain no diene-based polymer units, wherein the coating composition is selected such that the minimum baking temperature range of the second coating layer is above that of the first coating layer or overlaps with this range in such a manner that the lower limit of the range of the second coating layer is above the lower limit of the range of the first coating layer.

11 Claims, No Drawings

PROCESS FOR THE PRODUCTION OF MULTI-LAYER LACQUER COATINGS

BACKGROUND OF THE INVENTION

The present invention relates to a process for the production of a multi-layer lacquer coating by dry-on-wet application of a powder coating composition onto a substantially uncrosslinked, previously electrophoretically deposited lacquer layer, followed by the joint baking of these lacquer layers.

Industrial lacquer coating is distinguished by efforts to optimise lacquering processes in terms of environmental friendliness and energy consumption. Ways of moving towards this objective are, for example, the use of powder coating systems and economising on energy-intensive processing stages, such as for example reducing the number of baking stages. It is customary in this connection, in order not to expose the lower lacquer layers to excessive temperatures, when baking the individual layers for the baking temperatures of subsequent layers to be less than those of the preceding layers.

The application of a powder coating composition onto a dried, but uncrosslinked, previously electrophoretically deposited lacquer layer is known from JP 62 238 398 and from JP 63 274 800.

It is explained in EP-B-0 240 565 that powder coatings based on solid aromatic epoxy resins with an average of less than two epoxy groups per molecule have inadequate resistance to exposure to stress to ASTM D 2794 (impact indentation, impact test). Epoxy resin based powder coatings with an epoxy functionality of greater than 2 are thus used. The possibility of dry-on-wet application is not described.

EP-A-0 292 771 describes coating compositions which provide protection against stone impact based on epoxy resins which are elasticised by chemical modification with diene polymers. The coating compositions may be in powder form and may be applied to a crosslinked or uncrosslinked electrocoated lacquer layer.

EP-A-0 440 292 explains .that stability and viscosity problems occur in such powder coatings containing such elastomer-modified epoxy resins as described in EP-A-0 292 771. EP-A-0 440 292 thus describes the formulation of epoxy resin based powder coatings which contain elastomer-modified phenolic hardeners. These powder coatings may also be applied to a crosslinked or uncrosslinked electrocoated lacquer layer, wherein multi-layer lacquer coatings with good resistance to exposure to stress to ASTM D 2794 and good stone impact resistance are obtained.

It has been found that coating layers formed from the above-described powder coatings have a tendency to yellowing and embrittlement.

EP-A-0 449 359 moreover describes overcoming the stability problems of the elastomer-modified epoxy resins of EP-A-0 292 771 by producing a differently elastomer-modified epoxy resin. To this end, a carboxy-functional hydrogenated diene/vinyl aromatic block copolymer is dispersed in the liquid epoxy resin and reacted with it with the addition of catalyst and polyphenol. The powder coatings formulated on the basis of the epoxy resin elastomer-modified in this manner may be applied onto crosslinked or uncrosslinked electrocoated lacquer layers to yield multi-layer lacquer coatings resistant to stone impact.

All these powder coatings with binders or hardeners elastomer-modified in this manner, in particular the powder coating described in EP-A-0 449 359, have the common feature that the elastomer-modified components require elaborate synthesis.

SUMMARY OF THE INVENTION

The object of the invention was thus to provide a process for the production of a multi-layer lacquer coating with application of a powder coating composition onto an electrocoated lacquer layer, which process gives rise to non-yellowing coatings with good interlayer adhesion and good mechanical properties, such as good resilience, good stone impact resistance and impact resistance and a good, defect-free surface structure. It should furthermore be possible to perform the process with powder coating compositions having binders which are simple to produce or are commercially available.

DETAILED DESCRIPTION OF THE INVENTION

It has now been found that this object may be achieved if, on production of multi-layer lacquer coatings by dry-on-wet application of a powder coating onto a coating layer deposited from an electrocoating lacquer, certain conditions relating to the minimum baking temperatures of the two layers are fulfilled.

The present invention thus provides a process for the production of multi-layer lacquer coatings by electrophoretic deposition of a first coating layer of a first, aqueous coating composition onto an electrically conductive substrate, application of a second coating layer based on a second, powder coating composition and joint baking of the coating layers so obtained, which process is characterised in that a powder coating composition is used for the second coating layer which is based on binders which contain no diene-based polymer units, wherein the coating composition is selected such that the minimum baking temperature range of the second coating layer is above that of the first coating layer or overlaps with this range in such a manner that the lower limit of the range of the second coating layer is above the lower limit of the range of the first coating layer.

In contrast with the above-described prior art, it is not necessary according to the invention to use binders or hardeners which are rubber-modified by diene polymer modification. A preferred embodiment of the invention thus relates to the use of powder coating compositions for the second coating layer to be produced, the binder fractions of which are free of elastomer modification.

The minimum baking temperature range designates the range from 10° C. below to 10° C. above the lowest temperature which, at a defined baking duration of for example 20 minutes, is required in order to crosslink the lacquer layer in question. The state of crosslinking of the electrocoated lacquer layer may, for example, be determined by the action of acetone on the baked electrocoated lacquer layer and a subsequent scratch test. The following procedure may, for example be used:

A wad of cotton wool soaked in acetone is placed onto the baked electrocoated lacquer layer which has been left to stand for at least 4 hours and is covered with a watch glass. After 2 minutes, the watch glass and wad of cotton wool are removed and the lacquer layer left for one further minute. If, on examination with the naked eye, the electrocoated lacquer layer exhibits no changes and if the layer is not removable by the application of simple mechanical force, such as scratching with a blunt object, for example scratching with a thumb nail or the blunt end of a horn spatula (corresponding to a downwards acting weight of 4 kg), then crosslinking has occurred. This test is repeated on a series of lacquered test sheets, each of which has been baked for 20 minutes at differing temperatures, in order to determine the minimum baking temperature. The minimum baking temperature range is then defined as the range extending 10° C. above and below the minimum baking temperature determined in this manner.

The state of crosslinking of the second lacquer layer formed from the powder coating composition may, for example, be determined using ASTM standard D 2794. The following procedure may, for example be used:

A direct impact test (c.f. ASTM D 2794) is performed on a lacquer layer applied to a thickness of 70 μm on a customary bodywork steel sheet (sheet thickness 0.8 mm), which has been baked and left to stand for at least 24 hours at 20° C. To this end, a 4 lb weight with a spherical diameter of ⅝ of an inch is dropped vertically in free fall onto the lacquer layer to be tested from various heights, measured in inches. If the indented lacquer layer passes this test at a value of 20 inch-pounds (product of drop height×weight) and above without damage such as cracking or flaking being visible to the naked eye, then crosslinking has occurred. This test is repeated on a series of lacquer coated test sheets in order to determine the minimum baking temperature. The minimum baking temperature range is then defined as the range extending 10° C. above and below the minimum baking temperature determined in this manner.

Electrophoretically depositable coating compositions which may be used according to the invention are per se known anodically or cathodically depositable electrocoating lacquers which are subject to no particular restriction.

These are aqueous coating compositions with a solids content of, for example, 10–20 wt. %. The solids consist of customary binders, which bear substituents which are ionic or convertible into ionic groups, together with groups capable of chemical crosslinking, optionally together with pigments and further additives. The ionic groups may be anionic or convertible into anionic groups, for example —COOH groups, or cationic or convertible into cationic groups, for example amino, ammonium, for example quaternary ammonium, phosphonium and/or sulphonium groups. Binders with basic groups are preferred. Basic groups containing nitrogen are particularly preferred. These groups may be present in quaternised form or they are converted into ionic groups with a customary neutralising agent as is familiar to the person skilled in the art, for example an organic monocarboxylic acid, such as for example formic acid, acetic acid.

Examples of usable anionically depositable electrocoating binders and lacquers containing anionic groups are described in DE-A 28 24 418. These are, for example, binders based on polyesters, epoxy resin esters, poly(meth) acrylates, maleate oils or polybutadiene oils with a weight average molecular weight of, for example, 300–10000 and an acid value of 35–300 mg KOH/g. The binders bear —COOH, —$SO_3H$ and/or —$PO_3H_2$ groups. After neutralisation of at least a proportion of the acid groups, the resins may be converted into the aqueous phase. The lacquers may also contain customary crosslinking agents, for example triazine resins, crosslinking agents containing transesterifiable groups or blocked polyisocyanates.

Cathodic electrocoating lacquers based on cationic or basic binders are, however, preferred. Such basic resins are, for example, resins containing primary, secondary and/or tertiary amino groups, the amine values of which are, for example, 20 to 250 mg KOH/g. The weight average molecular weight ($M_w$) of the base resins is preferably 300 to 10000. Examples of such base resins are aminoacrylate resins, aminoepoxy resins, aminoepoxy resins with terminal double bonds, aminoepoxy resins with primary OH groups, aminopolyurethane resins, polybutadiene resins containing amino groups or modified epoxy resin/carbon dioxide/amine reaction products. These base resin may be intrinsically crosslinking or are used mixed with known crosslinking agents. Examples of such crosslinking agents are amino resins, blocked polyisocyanates, crosslinking agents with terminal double bonds, polyepoxy compounds or crosslinking agents containing transesterifiable groups.

Examples of base resins and crosslinking agents used in cathodic electrocoating baths which may be used according to the invention are described in EP-A 082 291, EP-A 234 395, EP-A 209 857, EP-A 227 975, EP-A 178 531, EP-A 333 327, EP-A 310 971, EP-A 456 270, US 3,922,253, EP-A 261 385, EP-A 245 786, DE-A 33 24 211, EP-A 476 514. These resins may be used alone or mixed.

It is particularly convenient for the process according to the invention to use cationic electrocoating lacquer baths having a relatively low minimum baking temperature range. This may, on the one hand, be achieved by selecting an appropriate binder/hardener system, i.e. it may be an intrinsic property of the binder systems themselves. In the context of the invention is has, however, also proved favourable to reduce the minimum baking temperature range to a low level by adding bismuth in the form of organic bismuth complexes and/or as bismuth salts of organic carboxylic acids. The salts may be .those of an organic mono- or polycarboxylic acid. Acetylacetone, for example, may be cited as an example of a complexing ligand. Other organic complexing agents with one or more complex-forming groups are, however, also possible. Examples of suitable organic carboxylic acids from which bismuth salts usable in the process according to the invention are derived, are aromatic, araliphatic and aliphatic mono- or dicarboxylic acids. Bismuth salts of organic monocarboxylic acids are preferred, in particular those with more than two C atoms, such as for example bismuth benzoate, propionate, octoate, neodecanoate. The bismuth salts of hydroxycarboxylic acids are particularly preferred in the process according to the invention. Examples are bismuth salicylate, bismuth 4-hydroxybenzoate, bismuth lactate, bismuth dimethylolproprionate. In particular, the bismuth salts of aliphatic hydroxycarboxylic acids are suitable.

The content of the organic bismuth compound in the cathodic electrocoating lacquer bath usable according to the invention is 0.1 to 5 wt. %, preferably 0.5 to 3.0 wt. %, calculated as bismuth and related to the binder solids content of the cathodic electrocoating lacquer bath. Care should be taken in this connection that the quantity of optionally introduced carboxylate ions does not have a negative influence upon the properties of the cathodic electrocoating lacquer. The organic bismuth compound may be present in the cathodic electrocoating lacquer usable in the process according to the invention dissolved in the aqueous or in the disperse phase, finely divided, for example in colloidal form, or as a ground powder. The compound should preferably be at least partially water soluble.

In industrial applications, the electrocoating process is generally combined with an ultrafiltration process. In this process, the soluble constituents from the electrocoating lacquer pass through a membrane into the ultrafiltrate. The process according to the invention may be performed using membrane-permeable organic bismuth compounds. Preferably, however, the organic bismuth compounds are selected from the bismuth compounds described above such that at the pH values prevailing in the cathodic electrocoating lacquer baths they have only slight membrane permeability, i.e. the ultrafiltrate in the process according to the invention should be substantially free of bismuth compounds. Reduction of the bismuth content in the cathodic electrocoating lacquer bath may be avoided in this manner.

The organic bismuth compounds described above may be incorporated into the cathodic electrocoating lacquer in various ways. For example, the organic bismuth compound may be added at elevated temperature to the neutralised binder solution before the addition of substantial quantities of water as diluent and then homogenised by stirring. The organic bismuth compound, preferably the organic bismuth salt, may for example be added in portions at 60° to 80° C. and then homogenised by stirring at 60° to 100° C., preferably at 60° to 70° C. for several hours, preferably 4 to 8 hours. If hydroxycarboxylic acids, such as for example lactic acid or dimethylolpropionic acid, are used as a neutralising agent for the binder, the appropriate quantities of bismuth oxide or hydroxide may alternatively be used, wherein the corresponding bismuth salt is formed in situ. The quantity of acid should here be increased over the amount in the initially stated process by the proportion necessary for salt formation.

It is moreover also possible to incorporate the organic bismuth compound into the cathodic electrocoating lacquer for example as a constituent of customary pigment pastes. The organic bismuth compounds, if they are soluble or are dissolved in a solubilising agent, may also subsequently be added to the cathodic electrocoating binder dispersion or to the cathodic electrocoating lacquer. Care must, however, be taken to ensure that they are uniformly distributed in the cathodic electrocoating lacquer bath.

Preferred cathodic electrocoating lacquer baths are those containing no heavy metal compounds harmful to health, such as for example lead compounds. Examples of such baths are described in EP-A-304 754, EP-A-341 596, EP-A-347 785, EP-A-414 199 and DE-A-4 222 596. Further examples of such lead-free cathodic electrocoating lacquer baths are those containing cationic lacquer binders crosslinkable by transesterification and/or transamidation and/or transurethanisation and/or by the reaction of terminal double bonds and bismuth in the form of an organic bismuth complex and/or of a bismuth salt or an organic carboxylic acid, as stated above.

In addition to the base resins and optionally present crosslinking agent, the electrocoating lacquer composition may contain pigments, extenders and/or customary lacquer additives. Pigments which may be considered are customary inorganic and/or organic pigments. Examples are carbon black, titanium dioxide, iron oxide, kaoline, talcum or silicon dioxide. If the coating compositions are used as an anticorrosion primer, it is possible for them to contain anticorrosion pigments. Examples of these are zinc phosphate or organic corrosion inhibitors. The quantity and type of pigments is determined by the intended purpose of the coating compositions. If clear coatings are to be produced, no pigments or only transparent pigments are used, such as for example micronised titanium dioxide or silicon dioxide. If opaque coatings are to be applied, the electrocoating lacquer bath preferably contains coloured pigments.

The pigments may be dispersed into pigment pastes, for example using known paste resins. Such resins are familiar to the person skilled in the art. Examples of paste resins which may be used in cathodic electrocoating lacquer baths are described in EP-A-0 183 025 and in EP-A-0 469 497.

Customary electrocoating lacquer additives are possible as additives. Examples are wetting agents, neutralising agents, flow-control agents, catalysts, antifoam agents, together with customary solvents. Crosslinking behaviour may be influenced by the type and quantity of catalysts. It may be advantageous to formulate the electrocoating lacquer composition without catalysts.

In the context of the present invention, it is preferred that the electrocoating lacquers used have a pigment/binder ratio of at most 1:1 by weight. Electrocoating lacquers, in particular cathodic electrocoating lacquers, with pigment/binder ratios of 0.1:1 to 0.7:1 are preferred.

The electrocoating lacquers used have minimum baking temperature ranges which are preferably in the range between 80° and 190° C., particularly preferably between 100° and 180° C. and in particular preferably less than 160° C. The minimum baking temperature ranges of the electrocoating lacquers may overlap with the minimum baking temperature ranges of the subsequent powder coating compositions. The lower limit of the minimum baking temperature range of the electrocoating lacquers is in this case below the lower limit of the minimum baking temperature range of the subsequently applied powder coating composition. Particularly preferably, the range of the electrocoated lacquer layer is below that of the subsequent layer.

The coating compositions which may be applied as the second layer dry-on-wet onto the uncrosslinked electrocoated lacquer layer according to the invention are powder coating compositions, for example powder topcoats, fillers and stone impact protection materials, the minimum baking temperature range of which is above that of the electrocoated lacquer layer, or overlaps with this range such that the lower limit of its range is above the corresponding lower limit of the electrocoated lacquer layer.

Binder systems consisting of base resin and hardener are used in the powder coating compositions which may be applied in the process according to the invention. The base resin is taken to be the film-forming, relatively high molecular weight component of a powder coating, which generally constitutes at least 50 wt. % of the underlying base resin/hardener combination, while the hardener component generally comprises at most 50 wt. % of this combination. Selection of the binder system used in the powder coating composition is not subject to any fundamental restrictions, with the exception of the above-stated explanations concerning the relative position of the minimum baking temperature range. It is preferred according to the invention to use only customary commercial binder systems, or such systems which may be prepared without elaborate synthesis. The binder systems consisting of base resin and hardener should contain no diene-based polymer units and should thus in particular contain no olefinic double bonds which may be subject to autooxidative attack. Suitable base resins are, for example, those customarily used for powder coatings. Examples are: polyester resins, (meth) acrylic copolymers, epoxy resins, phenolic resins, polyurethane resins, siloxane resins. The base resins have glass transition temperatures of, for example, 30°–120° C., preferably of less than 80° C., and have number average molecular weights of, for example, 500–20000, preferably of less than 10000. The hardeners have number average molecular weights of, for example, 84–3000, preferably of less than 2000. Various base resins and hardeners may be mixed together, provided that a fully compatible binder system is obtained in this manner, as may for example be detected by a minimum gloss value of the resultant, completely baked lacquer film of 75 units at an observation angle of 60 degrees.

The base resins and hardeners bear complementary functional groups which allow a crosslinking reaction under the baking conditions of the powder coating. Examples of functional groups are carboxyl groups, epoxy groups, aliphatically or aromatically bonded OH groups, silanol groups, isocyanate groups blocked isocyanate groups, anhydride groups, primary or secondary amino groups, blocked amino groups, N-heterocyclic groups capable of ring-opening addition, such as for example oxazoline groups, (meth) acryloyl groups, CH-acid groups, such as for example acetoacetate groups.

Selection of the groups which react with each other is familiar to the person skilled in the art. Examples may be found in H. Kittel, *Lehrbuch der Lacke und Beschichtungen* [textbook of lacquers and coatings], volume 4, page 356, Verlag W. A. Colomb, Berlin, 1976. Different reactive groups may optionally be combined. This may be achieved with binders bearing different reactive functional groups, or mixtures of different hardeners and/or base resins are used.

The different functional groups may be present simultaneously on the base resin and/or hardener, provided that they are not reactive with each other under production conditions. The base resins and/or hardeners contain on average at least 2 functional groups per molecule. The ratio of base resin to hardener is generally 98:2 to 50:50. It is preferably between 95:5 and 70:30. More than one base resin and/or more than one hardener may also be used in the mixture.

Examples of base resins and hardeners and or base resin/hardener combinations suitable in the context of the present invention may be found in *The Science of Powder Coatings,* volume 1, by D. A. Bate, Selective Industrial Training Associates Ltd., London, 1990.

In the context of the present invention, it is preferred to perform the dry-on-wet application of powder coating compositions based on base resin/hardener combinations which, on baking, allow crosslinking with the formation of urethane or carboxylic acid ester groups. Examples of systems which crosslink by forming urethane groups are combinations of solid, hydroxy-functional polyesters with solid, blocked polyisocyanates. Such polyesters have hydroxyl values of, for example, 25 to 55 mg KOH/g, while the blocked polyisocyanates have latent NCO values of, for example, 8 to 19. Particularly preferred are systems which crosslink to form ester groups by polyaddition without the elimination of organic compounds. Examples of such systems are powder coating compositions based on polyepoxides, such as for example epoxy resins or also low molecular weight polyepoxide compounds, such as triglycidyl isocyanurate, in combination with compounds with carboxyl and/or carboxylic anhydride functional groups. Preferred epoxy resins are customary commercial solid aromatic epoxy resins, for example based on diphenols such as bisphenol A. The epoxy resins preferably have an average epoxy functionality of between 1.05 and 2 per molecule and it is particularly preferred that they are not modified with hydrogenated or unhydrogenated diene polymers. Their epoxy equivalent weights are, for example, between 455 and 4000. Examples of solid compounds with carboxyl and/or carboxyl anhydride functional groups which may act as hardener or as base resin are polycarboxylic acids and/or the anhydrides thereof or preferably non-linear, acid polyesters with an average carboxyl functionality of greater than 2 per molecule. The acid values of these carboxyl compounds are, for example, between 20 and 450 mg KOH/g.

The powder coating compositions which may be used as the second layer according to the invention may contain customary powder coating extenders and/or pigments and preferably have pigment/binder ratios of between 0:1 and 0.5:1. The binder should here be taken to the sum of base resin plus hardener.

It has surprisingly been found that particularly favourable mechanical properties, in particular elevated impact strength, are achieved according to the invention if the powder coatings used are those which contain no extenders and/or pigments. Excellent impact strengths may be achieved even in the absence of organic extenders. The process according to the invention is thus particularly suitable for the production of stone impact protection interlayers and/or filler layers in multi-layer lacquer coatings. This effect is particularly surprising as it has in the past in practice been considered necessary to provide stone impact protection layers and filler layers with relatively high contents of pigments and extenders.

It is nonetheless possible according to the invention to use powder coatings which contain customary extenders and/or pigments. Such addition may, for example, be favourable for optical reasons. It may also be convenient for optical reasons to colour the powder coatings with soluble dyes; this variant is suitable particularly for the preferred embodiment of the powder coatings containing no pigments and extenders.

Examples of inorganic extenders and pigments are carbon black, titanium dioxide, zinc sulphide, iron oxide pigments, chromium oxide pigments, silicon dioxide, magnesium silicate (for example talcum), aluminium silicate (for example kaolin), calcium carbonate (for example chalk), barium sulphate (for example barytes), but also anticorrosion pigments, such as for example lead or chromate compounds. Examples of organic pigments are azo pigments, phthalocyanine pigments. It has been found in the context of the present invention that, if pigmented powder coatings are to be used in applications as stone impact primers or fillers, preferred powder coatings are those which a) contain organic extenders at a weight ratio of organic extender to binder of between 0.05:1 and 0.5:1, optionally combined with inorganic pigments and/or extenders, or b) have a low pigment/binder ratio of less than 0.1:1 by weight. Suitable organic extenders are various organic polymer powders, which may be used alone or as a mixture. Examples are polymer powders prepared from crosslinked urea/aldehyde resins, triazine/aldehyde resins, phenol/aldehyde resins, from polyacrylonitrile or from polyamide. These polymer powders have elevated glass transition temperatures of above 70° C. (measured by DSC). The glass transition temperatures are selected such that, under conditions of production and application of the powder coating compositions, no softening of the crosslinked or uncrosslinked polymer powders occurs. Accordingly, the polymer powders used are selected with melting points of above 130° C. or the polymer powders are infusible without decomposing, wherein the decomposition point is at elevated temperatures of above 220° C. Under production and processing conditions, the polymer powders are chemically inert and have average particle diameters of, for example, between 0.1 and 100 μm. Particle diameter is determined by the desired layer thickness and is selected such that it is sufficiently small so that a homogeneous and smooth surface is achieved on the applied and baked powder coating and on the lacquer film optionally applied hereto. In general, particle sizes of the polymeric extender particles of up to 10 μm are preferred, particularly preferably the upper limit to particle size is 5 μm. The lower limit is preferably approximately 1 μm. Particle size distribution of the polymer powders is variable.

The polymer powders may be produced in a customary manner known to the person skilled in the art and described in the literature. They may be produced as powders which are then ground to the desired grain size. It is, however, also possible by means of suitable reaction control to achieve desired grain sizes from the outset. The resultant powders may be used after separation from the reaction medium.

If aldehyde resin powders are used, they are highly crosslinked and do not have a melting point. The crosslinked aldehyde polymer powders may be produced by reacting urea, triazine and/or phenol with aldehyde, preferably with formaldehyde or formaldehyde-releasing compounds. The conditions in terms of the quantities of reaction partners used, the reaction temperature and the reaction medium in which the reaction is performed may be selected such that crosslinked, infusible compounds are produced. Such conditions are familiar to the person skilled in the art.

Polymer powders based on crosslinked triazine resins may also be used, such resins preferably including crosslinked melamine/aldehyde, benzoguanamine/aldehyde and acetoguanamine/aldehyde polymer compounds. Usable crosslinked urea resins and crosslinked phenolic resins are, for example, described in *Methoden der Organischen Chemie* [methods of organic chemistry] (Houben-Weyl), volume 2, *Makromolekulare Stoffe* [macromolecular substances] in the sections *Polyadditions— bzw. Polykondensationsprodukte yon Carbonyl— und Thiocarbonylverbindungen* [polyaddition and polycondensation products of carbonyl and thiocarbonyl compounds] on pages 193 to 365.

Examples of usable crosslinked phenol/aldehyde resin are, for example, described under the headword Resit [resire] in *Chemie der Phenolharze* [chemistry of the phenolic resins] by K. Hultzsch, Springer-Verlag, 1950.

If polyacrylonitrile powders are used as the polymer powder, they preferably have a molecular weight ($M_w$) of above 100000. They are not chemically crosslinked, but do not have a melting point as they decompose at temperatures of above 300° C. before they can melt.

Polyacrylonitrile powders suitable for use according to the invention may be homo- or copolymers; they contain at least 70 to 100 wt. % (preferably over 90 wt. %) of polymerised acrylonitrile and/or methacrylonitrile. The remainder may comprise one or more comonomers. Examples of comonomers are the acrylic acid esters and methacrylic acid esters of $C_1$ to $C_{22}$ alcohols, such as methyl methacrylate, butyl methacrylate, octyl methacrylate, ethyl acrylate, isobutyl acrylate, acrylic acid esters and methacrylic acid esters of perfluorinated $C_1$ to $C_{22}$ alcohols, vinyl aromatic monomers with up to 20 C atoms, for example styrene, vinyltoluene; esters of other unsaturated acids, such as maleic acid and fumaric acid esters of $C_1$ to $C_{22}$ alcohols, vinyl monomers, such as vinyl chloride, vinyl ethers and vinyl esters and mono- and diolefines, such as ethylene and butadiene.

Unsaturated carboxylic, sulphonic or phosphonic acids and the esters thereof may, for example, also be used as comonomers, such as crotonic acid, itaconic acid, vinylsulphonic acid, acrylamidopropylmethanesulphonic acid, vinylphosphonic acid and the esters thereof. Suitable comonomers also include unsaturated primary, secondary and tertiary amines, such as for example dimethylaminoneopentyl methacrylate, dimethylaminoneopentyl acrylate, 2-N-morpholinoethyl methacrylate, 2-N-morpholinoethyl acrylate or also acrylic and methacrylic acid amides, such as for example acrylamide, dimethylmethacrylamide and methylbutylacrylamide.

Still further functional monomers which are copolymerisable may also be used. They may contain hydroxy, silane or epoxy groups, such as for example vinyltrimethoxysilane, vinyltributoxysilane, methacryloxypropyltrimethoxysilane, vinyltris(methoxyethoxy) silane, vinyltriacetoxysilane, N-methylolacrylamide together with the alkyl ethers thereof, N-methylolmethacrylamide and the alkyl ethers thereof, hydroxyethyl methacrylate, hydroxybutyl acrylate, glycidyl acrylate, glycidyl methacrylate and hydroxyethyl acrylate.

The polyacrylonitrile powders are produced using customary processes which are known to the person skilled in the art. Examples are suspension polymerisation and emulsion polymerisation. The processes are described, for example, in *Chemische Technologie* [chemical technology], by Winnacker-Küchler, volume 6, *Organische Technologie* 2 [organic technology 2], Karl Hanser-Verlag, Munich/Vienna 1982. Characteristics of the polyacrylonitrile powder, such as for example the glass transition temperature and melting behaviour, may be influenced by selecting appropriate monomers. Particle size distribution may be influenced by means of the selected production process or by means of the processing parameters used in the manner familiar to the person skilled in the art.

The monomers, comonomers and customary auxiliary substances are selected such the requirements placed upon the polyacrylonitrile powder, such as particle diameter, glass transition temperature, molecular weight are achieved. The molecular weight ($M_w$) of the polyacrylonitrile powder is preferably at least 100000. After production, the polyacrylonitrile powders are dried to powders and then used, optionally after further grinding.

Polyamide powders which are used as the polymer powder may be produced from aminocarboxylic acids with, for example, 6 to 12 C atoms per molecule or from the lactams thereof, for example from ε-caprolactam, ω-aminododecanoic acid, lauryl lactam or mixtures thereof. Polycondensation products made from diamines, for example hexamethylenediamine, and dicarboxylic acids, for example adipic acid, sebacic acid, dodecanedicarboxylic acid and terephthalic acid, are also suitable. Mixtures of diamines and dicarboxylic acids and mixtures of lactams, diamines and acids may also be used.

In order to obtain polyamides with a higher functional group content, it is possible to use acids or amines of higher functionality, for example trimellitic acid or the anhydride thereof together with diethylenetriamine.

It is preferred on production of the polyamide if at least 70% of the reactable carboxyl groups are converted into amide groups. Further possible reactions include, for example, the formation of ester groups. The properties of the polyamides may be altered by polyether segments, for example in order to flexibilise them.

In this connection, polyester amides and copolyether amides may also be classed as polyamides, if at least 70% of the reactable carboxyl groups are converted into amide groups.

Industrial production of the polyamides may proceed by polycondensation of diamines or polyamines with dicarboxylic acids or polycarboxylic acids, by polycondensation of ω-aminocarboxylic acids or by ring-opening polymerisation of lactams. The polymer may be produced by bulk or solution processes. The polyamide may optionally be present in finely divided form during or after solution polymerisation.

The number average molecular weight of usable polyamides is preferably above 500 g/mol, preferably above 3000 g/mol. The polyamides contain at least 10, preferably at least 15 amide groups per molecule. Suitable polyamide powders may, for example, be obtained from the company ATO-Chemie under the trade names Orgasol (registered trademark) and Rilsan (registered trademark).

The polyamide powders should not melt, or at least not entirely, during baking.

The polymer powders may be adjusted to the desired particle size, wherein grinding processes using known grinders for size reduction are preferred.

If, as well as the polymer powders, the above-mentioned inorganic extenders and/or pigments are additionally used in the powder Coating compositions, the polymer powder fraction is preferably 5 to 99 vol. %, particularly preferably 5 to 60 vol. % related to the sum of volumes of extenders, pigments plus polymer powder.

The powder coating compositions may furthermore contain customary powder coating additives. Examples of such additives are flow-control auxiliaries, catalysts, waxes, degassing agents such as for example benzoin, antioxidants, light stabilisers, coupling agents, lubricants, agents controlling melt rheology.

The thermosetting powder coatings usable according to the invention are produced using processes known to the person skilled in the art, for example by extrusion of the powder coatings completely formulated by mixing together all the required components in the form of a pasty melt, cooling the melt to a solidified material, coarse size reduction, fine grinding and subsequent screening to the desired grain fineness (c.f. *Ullmanns Enzyklopädie der technischen Chemie* [Ullmanns encyclopedia of industrial chemistry], volume 15, page 680, 4th edition, 1978, Verlag Chemie Weinheim; and H. Kittel, *Lehrbuch der Lacke und Beschichtungen* [textbook of lacquers and coatings], volume 4, page 355, 1976 and volume 8, part 2, pages 1 et seq., 1980, Verlag W. A. Colonlb Berlin). The grain size of the powder coatings usable according to the invention is, for example, between 10 and 300 μm, the upper limit is preferably 100 μm, particularly preferably 60 μm.

Suitable substrates for the process according to the invention are electrically conductive materials, such as for example metals. Automotive bodies or parts thereof are in particular suitable, they may consist of metal, optionally phosphated and preferably pretreated in an environmentally friendly manner, for example without chromium, nickel and nitrate, or plastic which is electrically conductive or has been provided with an electrically conductive layer. The first coating layer, in particular in the form of an anticorrosion primer, is electrophoretically deposited onto these substrates in the customary manner.

The substrate may be rinsed with an aqueous solution in order to remove any non-adhering excess lacquer and any residual moisture is then preferably removed before dry-on-wet application of the subsequent coating composition. This removal is, for example, achieved by flashing off. This may, for example, be achieved by IR irradiation and/or by an optionally heated stream of air which is passed over the substrate. The temperature of the stream of air may, for example, be between room temperature and 120° C. The electrocoated lacquer film should not be crosslinked by this operation.

The second layer of the powder coating composition, for example a stone impact protection primer and/or filler layer is applied to the resultant substrate provided with an uncrosslinked electrocoated lacquer layer. The powder coating is preferably applied by spraying. Examples of such processes are tribospraying and electrostatic powder spraying (EPS). The workpiece with the two coating layers is then baked at elevated temperatures, for example between 130° and 220° C., preferably at above 150° C. The total thickness of the baked and chemically crosslinked two-layer lacquer coating, i.e. the sum of the electrocoated lacquer layer plus the powder coating layer applied thereto according to the invention is for example 40 to 200 μm, preferably 50 to 120 μm. If the powder coating is, for example, used to produce a filler layer, the filler layer thickness is, for example, between 30 and 70 μm, preferably between 35 and 60 μm, and if it is, for example, used as a stone impact protection primer, the layer thickness is between 50 and 120 μm, preferably between 60 and 100 μm.

The powder coating composition which, according to the invention, may be applied dry-on-wet onto an uncrosslinked electrocoated lacquer layer may also be simultaneously applied to a workpiece in different thicknesses, for example in order simultaneously to produce a filler and stone impact protection primer layer. Thus, for example when painting automotive bodies, the powder coating may be applied in a thickness typical of a stone impact protection primer in those areas of the body particularly exposed to stone impact, such as for example sills, front valence, some parts of the bonnet etc., while the remaining parts of the body are coated with the powder coating only in a thickness typical of a filler layer.

The multi-layer lacquer coatings which initially are obtained as a two-layer system can be overcoated with one or more further layers. To do so, the surface can after baking optionally be finished, for example by sanding, in order to eliminate any defects. Examples for the further layers are fillers (primer surfacers), topcoats and/or basecoat/clearcoat systems. Examples are coloured and/or effect lacquer layers, which may be produced by applying solvent-based or water-borne topcoat or base lacquers, preferably water-borne base lacquers. If the two-layer coating comprises only an electrocoated lacquer layer and stone impact protection primer without a filler layer, it is preferably overcoated with a filler layer based on a solvent-based or water-borne filler before application of a coloured and/or effect lacquer coating. The two-coat lacquer coating consisting of the uncrosslinked electrocoated lacquer layer and uncrosslinked powder coating may be gelled before application of the filler, topcoat or base lacquer layer. This is achieved at a temperature which allows the powder coating particles to flow together, but reliably excludes chemical crosslinking of the electrocoated lacquer layer and powder coating layer, for example at 80° to 130° C. In this way, after subsequent application of a further lacquer layer, preferably a filler layer, it is also possible to bake three lacquer layers simultaneously.

The coatings produced using the process according to the invention have good, optically smooth surfaces. Adhesion between the electrocoated priming layer and the second layer is good. Both layers are solidly attached. Due to the coordinated minimum baking temperature ranges, surface defects, such as for example craters or bubbles, may be avoided. If further subsequent layers are applied, both adhesion and surface smoothness are good.

Using the process according to the invention, it is possible to produce optically smooth, stone impact resistant multi-layer coatings with good mechanical properties which fulfil the requirements of mass produced automotive lacquer coating.

This range of properties may be achieved with the process according to the invention using powder coatings based on customary commercial binders and hardeners, which require no particular modification, for example elasticisation.

EXAMPLE 1 (production of a lead-free cathodic electrocoating lacquer)

A lead-free cataphoresis lacquer was prepared in accordance with EP-0 414 199 A2, table 3, binder combination 2. The cataphoresis lacquer thus contained 0.5 parts carbon black, 35.5 parts titanium dioxide, 5 parts hexyl glycol, each related to 100 parts of solid resin.

The minimum baking temperature range of this cataphoresis lacquer was determined as follows:

A lacquer layer of 20 μm dry layer thickness was formed by cathodic deposition on customary test sheets of bodywork steel. After rinsing away excess lacquer with fully deionised water and 5 minutes drying at 80° C. (object temperature) in a drying oven (extraction operation), the test sheets were baked for 20 minutes at object temperatures differing by 10° C. steps starting from 120° C. After the test sheets had cooled to room temperature and been left to stand for 4 hours, an acetone-soaked wad of cotton wool covered with a watch glass was placed on each test sheet for 2 minutes and, 1 minute after removal of the wad of cotton wool, crosslinking was tested by scratching the area exposed to the solvent with a thumb nail (corresponding to a downwards acting weight of 4 kg). The lacquer layers on the test sheets baked at 120°, 130° and 140° C. could be removed in this manner. The lacquer layers baked at 150° C. and 160° C. passed the removal test. The minimum baking temperature range is thus 140° to 160° C.

EXAMPLE 2 (production of organic bismuth salts)

Deionised water and acid are introduced into a reaction vessel and heated to 70° C. Customary commercial bismuth oxide ($Bi_2O_3$) is stirred in in portions. After a further 6 hours' stirring at 70° C., the batch is cooled to approximately 20° C. and left to stand for 12 hours without stirring. Finally, the precipitate is filtered out, washed with a little water and ethanol and dried at a temperature of 40°–60° C.

The following salts are produced using the stated proportions:

| | |
|---|---|
| Bismuth lactate: | 466 parts (1 mol) bismuth oxide + 901 parts (7 mol) 70% aqueous lactic acid |
| Bismuth dimethylol-propionate: | 466 parts (1 mol) bismuth oxide + 938 parts (7 mol) dimethylol-propionic acid + 2154 parts water. |

EXAMPLE 3 (production of cathodic electrocoating lacquer containing bismuth)

a) 570 g of a bisphenol A epoxy resin (epoxy equivalent 190) and 317 g of methoxypropanol are heated to 60° C., combined within 2 hours with a mixture of 116 g of ethylhexylamine and 163 g of a polymeric amine (see below) and reacted to an MEQ value of 2.06. 1330 g of a 75% solution of a hisphenol A epoxy resin (epoxy equivalent 475) in methoxypropanol is then added. A solution of 189 g of diethanolamine in 176 g of methoxypropanol is then added at 60° C. within an hour and the reaction continued to an MEQ value of 1.57. After addition of a further solution of 78 g of diethylaminopropylamine in 54 g of methoxypropanol within an hour, the reaction is continued at 60° C. to an MEQ value of 1.46. The temperature is raised to 90° C. and then within a further hour to 120° C. Once a viscosity (Gardner-Hold; 6 g resin+4 g methoxypropanol) of I–J is reached, the mixture is diluted with methoxypropanol to a solids content of 65 wt. %. The product has an amine value of 117 mg KOH/g and a hydroxyl value of 323 mg KOH/g, in each case related to solids.

The polymeric amine is produced by reacting 1 mol of diethylenetriamine with 3.1 mol of 2-ethylhexylglycidyl ether and 0.5 mol of a bisphenol A epoxy resin (epoxy equivalent 190) in an 80% methoxypropanol solution. The product has a viscosity (DIN 53 211/20° C.; 100 g resin+30 g methoxypropanol) of 60 to 80 seconds.

b) 134 g of trimethylolpropane are combined with 160 g of diethyl malonate and heated until distillation begins (approx. 140°–150° C.). 46 g of ethanol are distilled off under a rising temperature (to 180° C.). On completion of the reaction, the mixture is diluted with 128 g of diethylene glycol dimethyl ether and cooled to 60° C. 264 g of a reaction product of 1 mol of tolylene diisocyanate and 1 mol of ethylene glycol monoethyl ether are added within 4 hours and reacted at 60° C. to an NCO content of less than 0.02 milliequivalents per g of sample.

The resultant product has a solids content of 80±2 wt. % (30 minutes, 120° C.), a Gardner-Hold viscosity (10 g product+2 g diethylene glycol dimethyl ether) of K and a refractive index n 20/d of 1.4960.

c) The products obtained in a) and b) are mixed in a 70:30 ratio (related to solids). Lactic acid is then added, wherein the quantity required to achieve perfect water solubility was determined in preliminary tests. The mixture is heated to 70° C. and within two hours bismuth dimethylolpropionate is added in portions in a quantity such that 1.5 wt. % of bismuth, related to solids, are present in the batch. The batch is then stirred for a further 6 hours at 60°–70° C. and finally diluted with methoxypropanol to a solids content of 65 wt. %.

d) A cathodically depositable electrocoating lacquer with 18 wt. % solids content is produced in a customary manner in accordance with the formulation, 100 parts binder, 39.5 parts titanium dioxide and 0.5 parts carbon black.

The minimum baking temperature range of this cataphoresis lacquer was determined at 140° to 160° C. using the method described in example 1.

EXAMPLE 4 (production of a cathodic electrocoating lacquer)

A cataphoresis lacquer was produced in accordance with EP-0 476 514 A1, table 4, binder mixture 11 (final line of table).

The minimum baking temperature range of this cataphoresis lacquer was determined at 180° to 200° C. using the method described in example 1.

EXAMPLE 5 TO 7 (production of powder coatings)

After premixing the powder coating components (according to formulations 5–7) with a high speed plough mixer, the mixture was melted in a customary manner, extruded and, once cool, ground in a powder mill (particle size in examples 5 and 6 less than 100 μm, particle size in example 7 less than 60 μm).

The minimum baking temperature range of the powder coating was determined as follows:

The powder coatings according to formulations 5, 6 and 7 were applied to a layer thickness of 70 μm onto 0.8 mm thick test sheets of customary bodywork steel. The test sheets were baked for 10 minutes at object temperatures differing by 10° C. steps starting from 120° C. Once the test sheets had cooled to room temperature and had been left to stand for 24 hours at 20° C., a direct impact test (c.f. ASTM D 2794) was performed. To this end, a 4 lb weight with a spherical diameter of ⅝ of an inch was dropped vertically in free fall onto the lacquer layer to be tested from various heights, measured in inches. The indented lacquer layer was visually examined in each case. If the indented lacquer layer passed this test at a value of 20 inch-pounds (product of drop height×weight) and above without damage such as cracking or flaking being visible to the naked eye, then crosslinking had occurred. The minimum baking temperature range was then defined as the range extending 10° C. above and below the minimum baking temperature determined in this manner. The following minimum baking temperature ranges were determined: formulation 5: 170°–190° C.; formulation 6: 190°–210° C., formulation 7: 150°–170° C.

Formulation 5

| | |
|---|---|
| 30.4 | parts of a customary commercial linear polyester with an acid value of 75 |
| 26.0 | parts of a customary commercial bisphenol A epoxy resin with an epoxy equivalent weight of 630 |
| 2.8 | parts of a customary commercial polyacrylate based flow-control agent as a masterbatch (15% in an OH-polyester) |
| 0.7 | parts of polyethylene wax |
| 0.5 | parts of benzoin |
| 2.8 | parts of a customary commercial catalyst for reacting epoxy groups with carboxyl groups |
| 6.8 | parts of barium sulphate |
| 28.5 | parts of titanium dioxide |
| 0.1 | parts of iron oxide yellow |
| 1.4 | parts of iron oxide black |

Formulation 6

| | |
|---|---|
| 50.7 | parts of a customary commercial linear polyester with a glass transition temperature of 68° C. and a hydroxyl value of 50 |
| 7.2 | parts of a customary commercial flow-control agent as a master batch with 10% active ingredient content |
| 14.5 | parts of a customary commercial ε-caprolactam blocked cycloaliphatically based polyisocyanate with a latent NCO value of 15.0 |
| 16.8 | parts of titanium dioxide |
| 8.4 | parts of barium sulphate |
| 1.0 | part of benzoin |
| 0.1 | parts of microwax |
| 0.6 | parts of an RAL 7035 masterbatch (in calcium carbonate) |
| 0.7 | parts of carbon black (10% in calcium carbonate) |

Formulation 7

| | |
|---|---|
| 44.55 | parts of a customary commercial bisphenol A epoxy resin with an epoxy equivalent weight of 775 |
| 6.40 | parts of the flow-control agent from formulation 5 |
| 44.55 | parts of a customary commercial linear polyester with a glass transition temperature of 53° C. and an acid value of 70 |
| 4.5 | parts of a customary commercial ε-caprolactam blocked polyisocyanate based on a cycloaliphatic isocyanate adduct with a blocked NCO content of 9.5 wt. % |

Production of multi-layer lacquer coatings

EXAMPLE 8 (comparative example)

The cataphoresis lacquer according to example 1 is cathodically deposited to a dry layer thickness of 20 μm onto a test sheet of bodywork steel. After rinsing off excess lacquer with completely deionised water, the test sheet is baked for 25 minutes at 180° C. (object temperature). The powder coating from example 5 is electrostatically applied onto the cooled substrate at 70 kV to a thickness of 70 μm. The test sheet is then baked for 15 minutes at 200° C. (object temperature). Once cool, the lacquered test sheet is sprayed to a dry layer thickness of 40 μm with a customary single layer topcoat lacquer for mass produced automotive lacquer coatings and baked for 30 minutes at 130° C. (object temperature).

EXAMPLE 9 (comparative example)

Example 8 is repeated with the difference that the powder coating from example 6 is used instead of the powder coating from example 5.

EXAMPLE 10 (comparative example)

Example 8 is repeated with the difference that the cataphoresis lacquer from example 3 is used instead of the cataphoresis lacquer from example 1 and the cataphoresis lacquer is baked at 160° C. (object temperature).

EXAMPLE 11 (comparative example)

Example 9 is repeated with the difference that the cataphoresis lacquer from example 3 is used instead of the cataphoresis lacquer from example 1 and the cataphoresis lacquer is baked at 160° C. (object temperature).

EXAMPLE 12 (comparative example)

Example 8 is repeated with the difference that the cataphoresis lacquer from example 3 is used instead of the cataphoresis lacquer from example 1 and the cataphoresis lacquer is baked at 160° C. (object temperature) and that the powder lacquer from example 7 is used (voltage 35 kV) instead of the powder coating from example 5 and the powder coating is baked at 180° C. (object temperature).

EXAMPLE 13 (according to the invention)

The cataphoresis lacquer according to example 1 is cathodically deposited to a dry layer thickness of 20 μm (achieved if baked alone) onto a test sheet of bodywork steel. After rinsing off excess lacquer with completely deionised water and 5 minutes drying at 80° C. (object temperature) in a drying oven (extraction operation), the powder coating from example 5 is applied electrostatically at 70 kV dry-on-wet to a 70 μm layer thickness. The test sheet is then baked for 15 minutes at 200° C. Once cool, the lacquered test sheet is sprayed to a dry layer thickness of 40 μm with a customary single layer topcoat lacquer for mass produced automotive lacquer coating and baked for 30 minutes at 130° C. (object temperature).

EXAMPLE 14 (according to the invention)

Example 13 is repeated with the difference that the powder coating from example 6 is used instead of the powder coating from example 5.

EXAMPLE 15 (according to the invention)

Example 13 is repeated with the difference that the powder coating from example 7 is used (voltage 35 kV) instead of the powder coating from example 5 and the cathodic electrocoating lacquer and powder coating are baked together at 180° C. (object temperature).

EXAMPLE 16 (according to the invention)

Example 13 is repeated with the difference that the cataphoresis lacquer from example 3 is used instead of the cataphoresis lacquer from example 1.

EXAMPLE 17 (according to the invention)

Example 14 is repeated with the difference that the cataphoresis lacquer from example 3 is used instead of the cataphoresis lacquer from example 1.

EXAMPLE 18 (according to the invention)

Example 15 is repeated with the difference that the cataphoresis lacquer from example 3 is used instead of the cataphoresis lacquer from example 1.

EXAMPLE 19 (comparative example)

Example 8 is repeated with the difference that the cataphoresis lacquer from example 4 is used instead of the cataphoresis lacquer from example 1 and the cataphoresis lacquer is baked at 200° C. (object temperature) and that the powder coating from example 7 is used (voltage 35 kV) instead of the powder coating from example 5 and the powder coating is baked at 180° C. (object temperature).

EXAMPLE 20 (comparative example)

Example 8 is repeated with the difference that the cataphoresis lacquer from example 4 is used instead of the cataphoresis lacquer from example 1 and the cataphoresis lacquer is baked at 200° C. (object temperature).

EXAMPLE 21 (Comparative example)

Example 15 is repeated with the difference that the cataphoresis lacquer from example 4 is used instead of the cataphoresis lacquer from example 1 and the cathodic electrocoating lacquer and powder coating are baked together at 200° C. (object temperature).

EXAMPLE 22 (comparative example)

Example 13 is repeated with the difference that the cataphoresis lacquer from example 4 is used instead of the cataphoresis lacquer from example 1.

Reverse impact testing[1]) (c.f. ASTM D 2794) of the multi-layer lacquer coatings produced according to examples 8 to 22 yields the following contrasting results:

| Example | inch-pound | kg × m |
|---|---|---|
| 8 (comparison) | 45 | 0.5185 |
| 9 (comparison) | 45 | 0.5185 |
| 10 (comparison) | 40 | 0.4609 |
| 11 (comparison) | 40 | 0.4609 |
| 12 (comparison) | 35 | 0.4033 |
| 13 (according to the invention) | 55 | 0.6337 |
| 14 (according to the invention) | 60 | 0.6914 |
| 15 (according to the invention) | >80 | 0.9218 |
| 16 (according to the invention) | 50 | 0.5761 |
| 17 (according to the invention) | 50 | 0.5761 |
| 18 (according to the invention) | 70 | 0.8066 |
| 19 (comparison) | 40 | 0.4609 |
| 20 (comparison) | 30 | 0.3457 |
| 21 (comparison) | <2 | <0.0230 |
| 22 (comparison) | <10 | <0.1152 |

-continued

| Example | inch-pound | kg × m |
|---|---|---|

[1])0.9072 kg, 15.875 mm (2 lb, ⅝ inch); reverse dent; at room temperature to ASTM D 2794.

The value in inch-pounds or kg×m is in each case the upper limit for a good result, i.e. no cracking or flaking is discernible with the naked eye.

We claim:

1. Process for the production of multi-layer lacquer coatings by electrophoretic deposition of a first coating layer of a first, aqueous coating composition onto an electrically conductive substrate, application of a second coating layer based on a second, powder coating composition and joint baking of the coating layers so obtained, which process is characterised in that a powder coating composition is used for the second coating layer which is based on binders which contain no diene-based polymer units, wherein the coating composition are selected such that the second coating composition has a minimum baking temperature range above that of the first coating composition or overlaps the latter in such a manner that the lower limit of the range of the second coating composition is above the lower limit of the range of the first coating composition.

2. Process according to claim 1, characterised in that the coating compositions are selected such that the minimum baking temperature range of the second coating composition is above that of the first coating composition.

3. Process according to claim 1, characterized in that the first coating composition used is a cathodic electrocoating lacquer based on intrinsically or extrinsically crosslinking binders containing at least partially neutralized primary, secondary, tertiary amino groups or a mixture thereof, with an amine value of 20 to 250 and a weight average molecular weight of 300 to 10,000.

4. Process according to claim 3 wherein said aqueous coating composition contains binder selected from the group consisting of aminoacrylate resins, aminoepoxy resins, aminopolyurethane resins, polybutadiene resins containing amino groups or modified epoxy resin/carbon dioxide/amine reaction products.

5. Process according to claim 1, characterised in that the powder coating composition is based on film-forming base resins with glass transition temperatures of 30° to 120° C. and a number average molecular weight of 500 to 20000.

6. Process according to claim 5, characterised in that the powder coating composition further contains no pigments and extenders.

7. Process according to claim 5, characterised in that the powder coating composition used which contains no inorganic pigments and inorganic extenders and contains as extenders one or more organic polymer powders which are chemically inert and do not soften under application and baking conditions.

8. Process according to claim 7, characterised in that the polymer powder used is a powder based on aldehyde condensation products, polyacrylonitrile resins, polyamide or a mixture thereof.

9. Process according to claim 3 wherein the cathodic electrocoating lacquer is lead-free.

10. Process according to claim 9 wherein said lead-free electrocoating lacquer also contains as a catalyst one or more members of the group consisting of organic bismuth complexes and bismuth salts of carboxylic acids.

11. Process according to claim 1 wherein at least one additional coating is further applied to said two layer coating after joint baking.

* * * * *